US006145596A

United States Patent [19]

Dallas

[11] Patent Number: 6,145,596

[45] Date of Patent: Nov. 14, 2000

[54] METHOD AND APPARATUS FOR DUAL STRING WELL TREE ISOLATION

[76] Inventor: L. Murray Dallas, 790 River Oaks Dr., Fairview, Tex. 75069

[21] Appl. No.: 09/268,460

[22] Filed: Mar. 16, 1999

[51] Int. Cl.[7] ..... E21B 33/047

[52] U.S. Cl. ..... 166/379; 166/77.4; 166/90.1; 166/97.5

[58] Field of Search ..... 166/379, 77.4, 166/97.5, 85.3, 90.1

[56] References Cited

U.S. PATENT DOCUMENTS

| | | | |
|---|---|---|---|
| 3,028,917 | 4/1962 | Rhodes | 166/97.5 |
| 4,241,786 | 12/1980 | Bullen | 166/77.4 |
| 4,632,183 | 12/1986 | McLeod | 166/77.4 |
| 4,867,243 | 9/1989 | Garner et al. | 166/379 |
| 4,993,489 | 2/1991 | McLeod | 166/72 |
| 5,775,420 | 7/1998 | Mitchell et al. | 166/85.4 |
| 5,794,693 | 8/1998 | Wright et al. | 166/85.5 |

*Primary Examiner*—Hoang Dang
*Attorney, Agent, or Firm*—Nelson Mullins Riley & Scarborough, LLP

[57] ABSTRACT

A dual string well tree isolation apparatus includes two assemblies each having a high pressure valve and a high pressure tubing which are respectively inserted into the vertical passage of a dual string well tree, and a swedge for connection to the dual string well tree for supporting one of the assemblies. The swedge vertically offsets one assembly from the other. The apparatus further includes a hydraulic cylinder for inserting the high pressure tubings and cylinder support rods for removable attachment of the hydraulic cylinder to the dual string well tree. The hydraulic cylinder and the support rods are removed after each insertion of a high pressure tubing into a respective vertical passage to provide easy access to the high pressure valve of each assembly. The advantage is a safe, economical apparatus for simultaneous stimulation of a dual string well completion.

17 Claims, 4 Drawing Sheets

METHOD AND APPARATUS FOR DUAL STRING WELL TREE ISOLATION

TECHNICAL FIELD

This invention relates to wellhead equipment of oil and gas wells and, more specifically to an apparatus for safely isolating dual string well trees from excessive pressures, abrasives and/or caustic solutions used to stimulate the production of certain oil and gas wells.

BACKGROUND OF THE INVENTION

Well tree isolation relates to the isolation of wellhead equipment on a hydrocarbon well from the high pressures and/or abrasive fluids required for well stimulation. A proportion of all oil and gas wells eventually require some form of stimulation to enhance their hydrocarbon flow and make them economically viable. Stimulation of an oil or gas well may be accomplished by several methods. One method involves pumping an acidic solution under pressure into the hydrocarbon bearing formation of a well. Another method is to hydraulically fracture the hydrocarbon bearing formations of a well. Hydraulic fracturing is the process of breaking open a hydrocarbon bearing formation by forcing into it liquids and/or gases which may be laden with abrasives. Extremely high pressures and high flow rates must be employed in the hydraulic fracturing process.

Wellhead equipment includes gate valves, ball valves, blow-out prevention stacks, drilling spools, tubing bonnets, tubing spools, casing spools, casing bores and all related flanges in various combinations, collectively referred to as a well tree. Generally, the well tree provides a means for safely controlling the flow from an oil, gas or water well which occurs from a hydrocarbon or water-bearing formation, the product being brought to the surface by means of production tubing strings. However, the conventional well trees installed in most oil and gas wells are generally not designed to withstand the pressures required to hydraulically fracture a well or, in some cases, to inject caustic fluids into the well. Most conventional well trees are designed for pressures of 21,000 kpa or less while pressures in excess of 21,000 kpa are often required in the hydraulic fracturing process. Therefore, when a well is to be stimulated, the well tree must either be upgraded to the necessary pressure requirements or it must be isolated from the elevated pressures required for the well stimulation process.

There are several known methods of isolating well trees. All the known methods are alike in that they require the insertion of a length of a high pressure tubing through a vertical passage defined by the well tree valves and flanges, the lower end of the high pressure tubing being sealed or packed-off in the production tubing or casing. Each method also requires a sealing mechanism attached to the top of the well tree to prevent well bore pressure from escaping into the atmosphere during insertion or the removal of high pressure tubing, and each requires a high pressure valve affixed to the top of the high pressure tubing to control pressure while the high pressure tubing is seated and packed-off in the production tubing or casing. The above principles of well tree isolation are common to all well tree isolation equipment. The difference in the well tree isolation methods reside in the mechanism by which the high pressure tubing is inserted through the well tree.

The Applicant's U.S. Pat. No. 4,867,243, for example, entitled WELLHEAD ISOLATION TOOL AND SETTING DEVICE AND METHOD OF USING SAME which issued on Sep. 19, 1989 discloses a well tree isolation apparatus. The apparatus comprises a single hydraulic cylinder supported in an axial alignment over a well tree by at least two elongated support rods. The hydraulic cylinder support rods are connected between a base plate and a hydraulic cylinder mounting plate to support the hydraulic cylinder above the well tree at a distance approximately equal to the height of the well tree. The apparatus permits the insertion of a single length of high pressure tubing through any well tree, regardless of its height. Once the high pressure tubing is seated in a production tubing or well casing, the hydraulic cylinder, hydraulic cylinder plate and supports rods are removed to provide 360° access to a high pressure valve attached to the top of the high pressure tubing.

Nevertheless, U.S. Pat. No. 4,867,243 fails to address an application of the apparatus disclosed therein to a dual string well tree. The dual string well tree includes two vertical passages, defined by two separate sets of well tree valves and flanges for respective control of fluid flow from two production tubing strings. The two production tubing strings extend through a single well casing and usually communicate with different hydrocarbon bearing formations. The dual string completion is less expensive and quicker to install than the more conventional use of a workover rig and workover fluids. For example, U.S. Pat. No. 5,775,420 entitled DUAL STRING ASSEMBLY FOR GAS WELLS, which issued to Mitchell et al. on Jul. 7, 1998, describes a dual completion for gas wells which includes a dual base with a primary hanger incorporated in the base. Primary and secondary coiled tubing strings extend through the base at a downwardly converging angle of two degrees or less. The dual base is mounted on an annular blowout preventer. At the top of the annular blowout preventer is a tubing centralizer that aligns the two tubing strings parallel to one another. The blowout preventer has two side ports below the bladder, permitting an operator to produce gas from the annulus, to flare gas to atmosphere or to pump in kill fluid in the event of an emergency. The alignment of the tubing strings allows production recorders to be run in either string.

The difficulty in isolating the dual string well trees is the closeness of the two well trees and the consequent lack of working space to enable a prior art well tree saver to be mounted above each well tree. To date, there has been no solution proposed for this problem.

SUMMARY OF THE INVENTION

It is therefore an object of the invention to provide a wellhead isolation apparatus which is suitable for application to a dual string well tree.

Another object of the invention is to provide an apparatus for inserting high pressure tubings through respective dual string well trees so that fluids, gases, solid particles and mixtures thereof can be injected into respective production tubing strings at high pressure and flow rates, without damaging the valves and flanges of the dual string well trees.

It is a further object of the invention to provide a method of isolating the respective well trees of a dual string wellhead to permit the stimulation of a production zone associated with a tubing string attached to each well tree.

In general terms, the invention provides an apparatus for injecting fluids, gases, solid particles or mixtures thereof into a well having first and second production tubing strings, the fluids being injected through a dual string well tree which has first and second vertical passages therethrough respectively aligned with the first and second production tubing strings and has at least one valve for selectively closing each passage, the apparatus comprising a first and a second assembly, each having a high pressure tubing for insertion through the respective first and second vertical passages to isolate the fluids, gases, solid particles or mixtures injected therethrough from an interior of each of the vertical passages; a swedge having an axial passage adapted to be detachably mounted to the dual string well tree in sealed alignment with one of the vertical passages, the swedge having a top end adapted to support one of the assemblies to vertically offset the one assembly from the other.

The high pressure tubing of the first assembly is aligned with the first vertical passage of the dual string well tree and inserted therein by an actuating mechanism. The actuating mechanism preferably is a hydraulic cylinder supported and connected to a support device fixable relative to the dual string well tree.

Upon insertion of the high pressure tubing of the first assembly and a successful packoff, the support mechanism and the entire hydraulic cylinder assembly including the hydraulic cylinder and the support device are quickly and easily removed from the wellhead. The swedge is placed in position, its axial passage being aligned with the second vertical passage of the dual string well tree and securely mounted to the same. Thereafter, the high pressure tubing of the second assembly is inserted from a top end of the swedge into the second vertical passage of the dual string well tree by an actuating mechanism which may preferably be the same hydraulic cylinder and the support device used for the insertion of the high pressure tubing of the first assembly. During the second insertion, there is no interference from the first assembly which remains on the top of the first well tree because the swedge extends the second vertical passage upwardly past the first assembly and vertically offsets the second assembly from the first.

Preferably, the invention comprises an apparatus for injecting fluids, gases, solid particles or mixtures thereof into a well having first and second production tubing strings, the fluids being injected through a dual string well tree which has first and second vertical passages therethrough respectively aligned with the first and second production tubing strings and has at least one valve for selectively closing each passage, the apparatus comprising:

a first and a second assembly for injecting the fluids through the respective first and second vertical passages, each of the assemblies including:

(a) a high pressure tubing for insertion through a respective one of the vertical passages;

(b) a high pressure valve connected to the high pressure tubing to selectively stop fluid flow through the high pressure tubing;

(c) a first sealing device adapted to prevent passage of the fluids and gases from an exterior of the high pressure tubing and an interior of the vertical passage to atmosphere;

(d) a second sealing device adapted to prevent passage of the fluids and gases from an interior of the high pressure tubing and an interior of the production tubing to the vertical passage when the high pressure tubing is inserted into the vertical passage; and (e) a hold down mechanism for detachably securing the high pressure tubing and the high pressure valve to the dual string well tree;

a swedge having an axial passage, adapted to be detachably mounted to the dual string well tree in alignment with the second vertical passage to extend the second vertical passage upwardly past the first high pressure valve when the high pressure valve is secured by the hold down mechanism, the second high pressure tubing being inserted into the second vertical passage from a top end of the swedge;

a hydraulic cylinder having an extendable and retractable piston rod that is respectively and detachably connected to each of the first and second assemblies for inserting the first high pressure tubing into the first vertical passage and the second high pressure tubing into the second vertical passage; and at least two elongated hydraulic cylinder support rods fixable relative to the dual string well tree in a respective position parallel with and offset from the vertical passages respectively and adapted to support the hydraulic cylinder in axial alignment with the respective vertical passage, the support rods and the hydraulic cylinder being removable from the dual string well tree when each of the high pressure tubings is operatively inserted into the respective vertical passage.

The apparatus of the invention permits the insertion of a single length of high pressure tubing through each vertical passage of any dual string well tree regardless of its height. It provides a simple method of using a swedge to vertically offset one assembly from the other, therefore, the first assembly does not interfere with the insertion of the high pressure tubing into the second assembly. The hydraulic cylinder and the supports rods are removed after each insertion of a high pressure tubing into a respective vertical passages to provide easy access to the high pressure valve of each assembly. The advantage is a safe, economical application for simultaneous stimulation of a dual string well completion.

DETAILED DESCRIPTION OF THE PREFERRED EMBODIMENT

Figure 1:
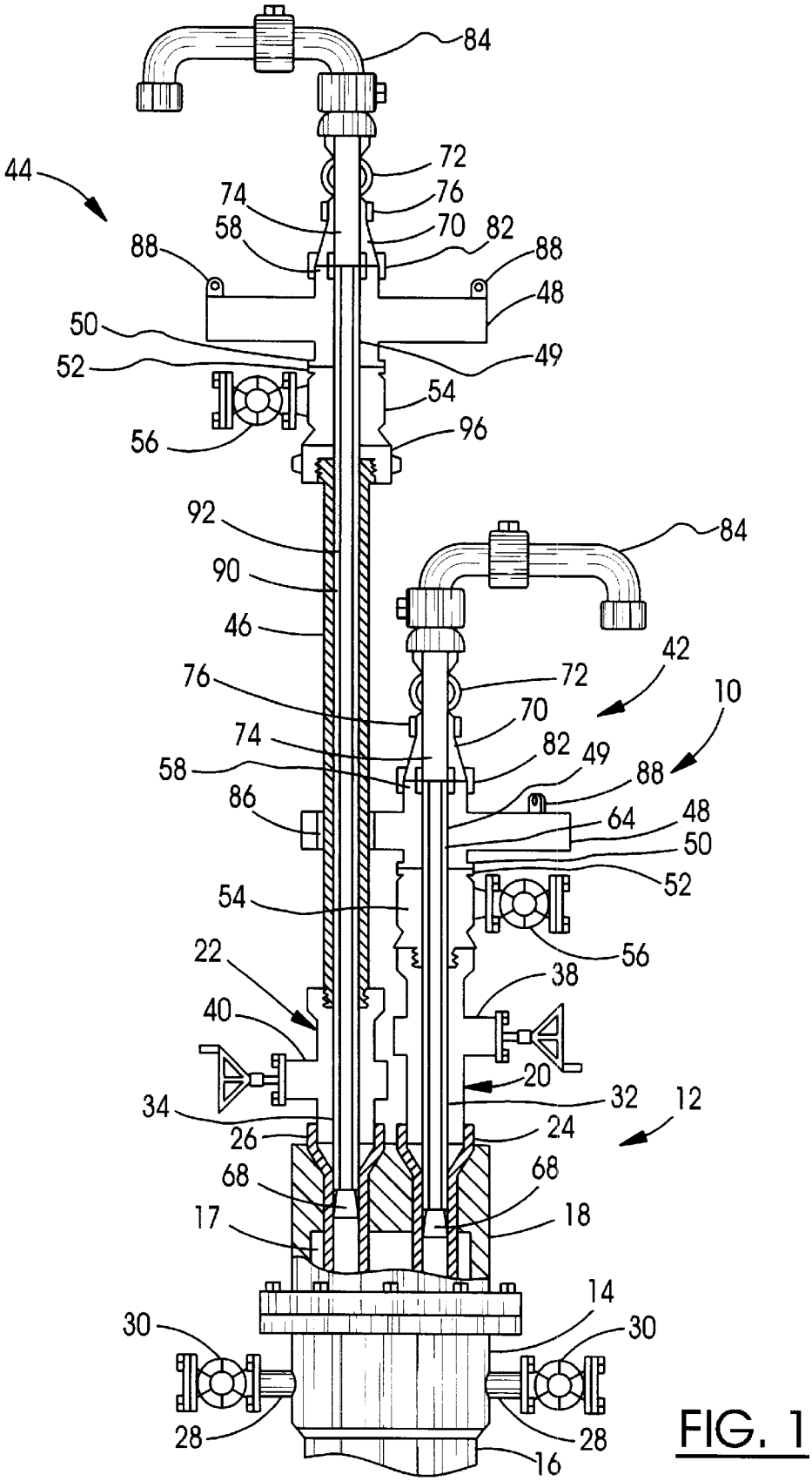
FIG. 1 shows a partially cut away side view of a dual string well tree with the isolation apparatus attached, with the hydraulic cylinder assembly removed and the wellhead ready for hydraulic fracturing or other wellhead isolation treatments.
Figure 2A:
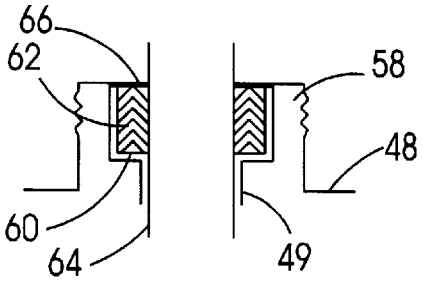
FIG. 2*a*, which appears on sheet four of the drawings, illustrates a detailed cross-section of packing in a stuffing box housing and the support rod base plate number shown in FIG. 2.
Figure 2B:
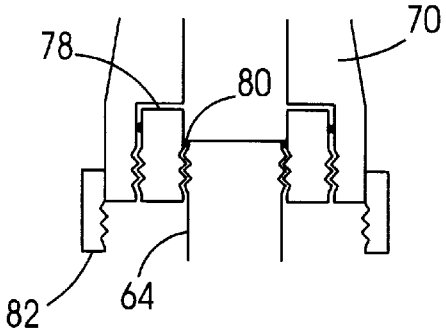
FIG. 2*b*, which also appears on sheet four of the drawings, illustrates a detailed cross-section of a connection between a top of the high pressure tubing and a bottom of a high pressure tubing connector shown in FIG. 2.
Figure 4A:
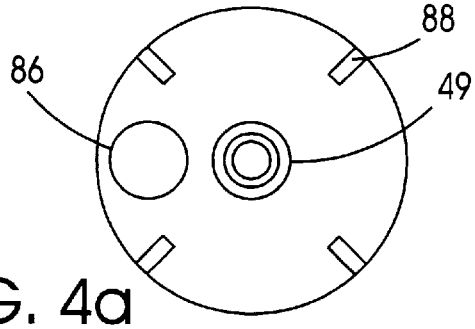
FIGS. 4*a*–4*d* are top plan views of base plate members showing optional embodiments of the base plate shown in FIGS. 1–3.
Figure 2C:
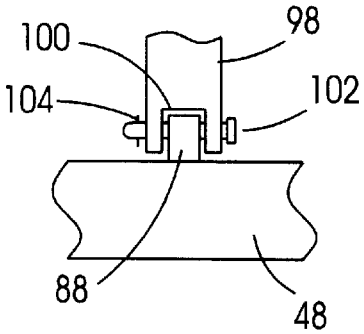
FIG. 2*c*, which likewise appears on sheet four of the drawings, is an enlarged partial side view of a connection of the support rods to the base plate member, taken from the circled area E of FIG. 2.
Figure 4B:
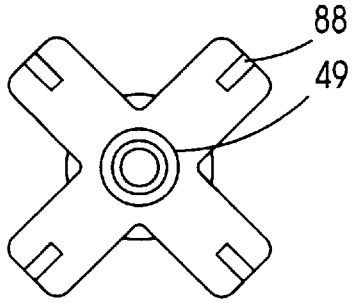
Figure 4C:
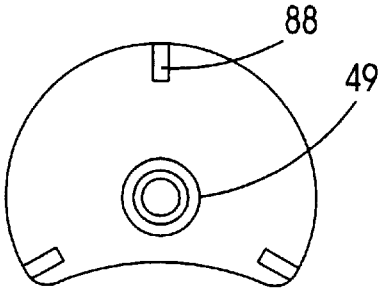
Figure 4D:
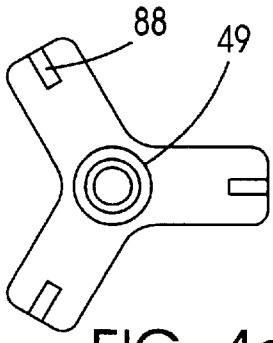
Figure 2:
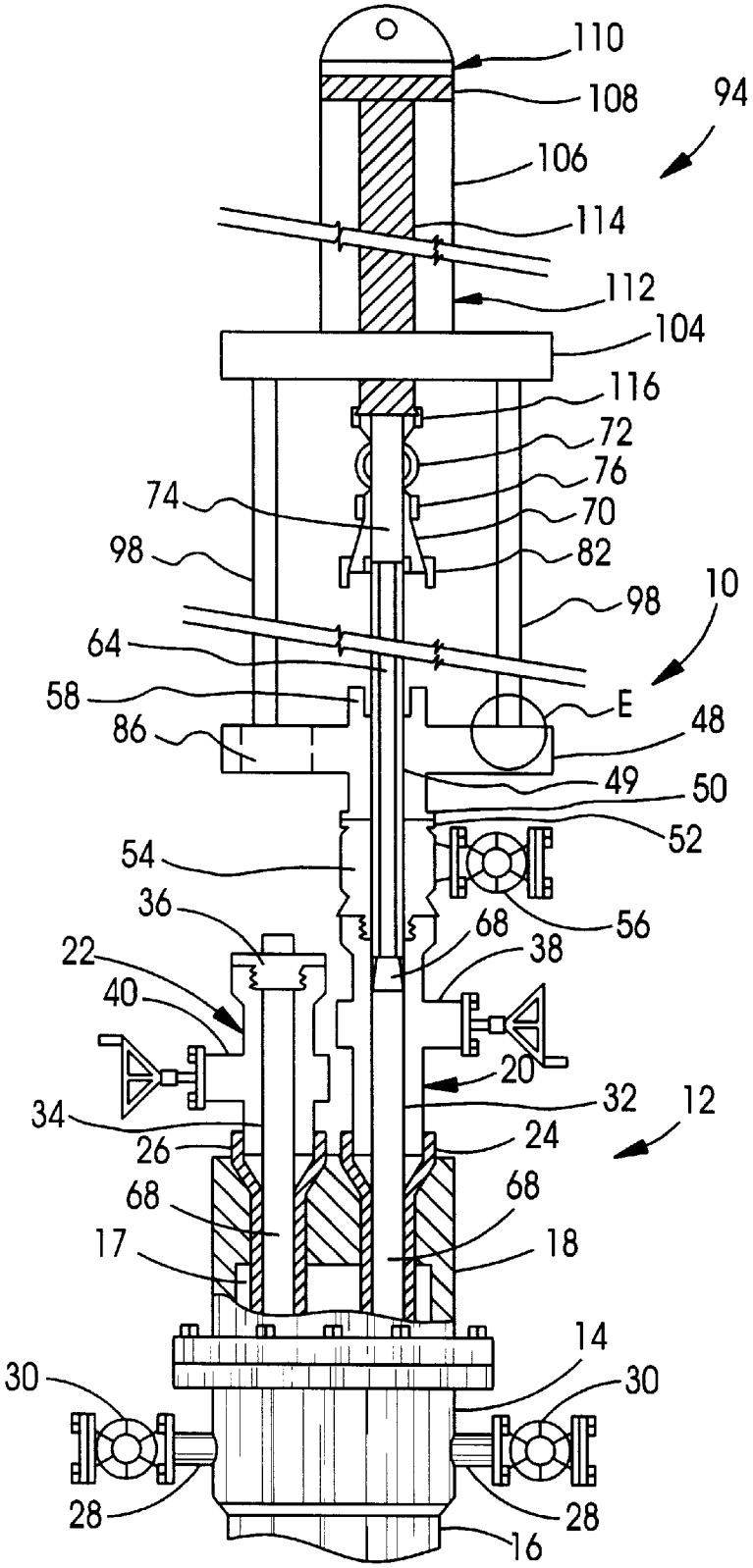
FIG. 2 shows a partially cut away side view of the dual string well tree shown in FIG. 1, with the first assembly of the well tree isolation apparatus attached, a hydraulic cylinder assembly being used to begin the insertion of the high pressure tubing into a first side of the dual string well tree.

In FIG. 1, a preferred embodiment of the invention is generally indicated by reference numeral 10, assembled atop a dual string well tree, generally indicated by reference numeral 12. The dual string well tree 12 includes a header spool 14 that is mounted to a well casing 16 and supports a dual base 18. The dual base 18 in turn supports a first stack 20 and second stack 22, the stacks 20, 22 are respectively connected via threads to two production tubing strings 24, 26 which are held by the dual base 18, and extend downwardly in parallel into the casing 16. Each production tubing string 24, 26 is in fluid communicating with a different hydrocarbon formation (not shown). The header spool 14 further includes two side ports (not shown) communicating with an annulus 17 that surrounds the two production tubing strings. The side ports are respectively connected to two nipples 28. Each of the nipples 28 is in turn coupled to a valve 30 to permit operators to draw fluids from the annulus 17, to flare gas to the atmosphere or pump kill fluid in the event of an emergency. The stacks 20, 22 respectively define the vertical passages 32, 34, which are more clearly illustrated in FIG. 2. The vertical passages 32, 34 are in sealed alignment and fluid communication with the production tubing strings 24, 26 and each is closed at its upper end by a cap 36, one of which is shown in FIG. 2 and both of which are removed from the dual string well tree 12 in FIG. 1 to permit the installation of the apparatus 10.

Two valves 38, 40 are provided on the first and second stacks 20, 22 to close or controllably open the vertical passages 32, 34 to control the fluid flow therethrough, respectively. The valves 38, 40 as well as the threaded connections between stacks 20, 22 and production tubing strings 24, 26 are not designed to withstand the high pressure of the fluids injected for well stimulation. It is desirable to protect the valves and the threaded connections from potential damage due to the high pressure and corrosive effects of the substances employed.

The structure of the dual string well tree 12 illustrated is simplified and the details of, for example, tubing hangers, seals and other parts are omitted from the drawing. The dual string well tree may include more equipment such as blowout preventers. However, the detailed structure of the dual string well tree is not important to the invention. Moreover, the vertical passages referred to in this document are not limited to a strictly vertical condition and slight deviations from the vertical are acceptable, for example, as disclosed in U.S. Pat. No. 5,775,420.

The isolation apparatus 10 generally includes a first isolation assembly 42, a second isolation assembly 44 and a swedge 46.

The first isolation assembly includes a base plate member 48 which is constructed from heavy steel plate. The base plate member 48 preferably has a cylindrical bore 49 therethrough of a diameter equal to or larger than the vertical passage 32. The base plate member 48 is connected by means of a connecting flange 50 to a flange 52 of a flow cross or tee 54 which has a side port (not shown) connected to a test valve 56. A stuffing box housing 58 is formed as part of the base plate member 48.

Figure 1A:
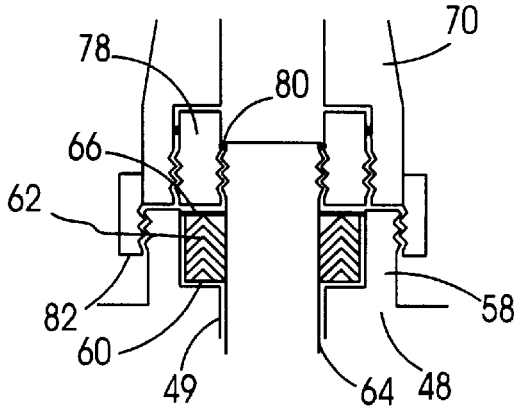
FIG. 1*a* is a cross-sectional detail of a threaded connection between a lower end of a high pressure tubing connector and a stuffing box housing illustrated in FIG. 1, and appearing in FIGS. 2*a*–2*c;*

As shown in FIG. 1*a*, located in an upper portion of the cylindrical bore 49, is steel sleeve 60 and packing rings 62 constructed of brass, rubber or fabric. The steel sleeve 60 and packing rings 62 define a cylindrical bore of the same diameter as the periphery of a high pressure tubing 64 passing through the cylindrical bore 49. The steel sleeve 60 and the packing rings 62 are removable and may be interchanged to accommodate different sizes of high pressure tubing 64. the steel sleeve 60 and the packing ring 62 are held in the cylindrical bore 49 of the base plate member 48 by means of a retainer nut 66. The high pressure tubing 64 extends through the retainer nut 66, packing rings 62, sleeve 60 and the cylindrical bore 49, and a packoff nipple assembly 68 is attached to the bottom end thereof, as illustrated in FIG. 1. A high pressure valve connector 70 and high pressure valve 72 are attached to the top of the high pressure tubing 64, which is described in detail below.

The base plate member 48 extends symmetrically in a horizontal direction from the cylindrical bore 49 and may be constructed as a single unit (as illustrated) or it may be constructed in two parts, the first part comprising the connecting flange 50, cylindrical bore 49 and stuffing box housing 58, and the second part comprising a symmetrical horizontal extension of the base plate which extends beyond the periphery of the dual string well tree. The two parts being secured together with threaded fasteners.

The high pressure tubing connector 70 is an elongated steel connector having a cylindrical bore 74 therethrough which has a diameter equal to or larger than the vertical passage 32. The top of the high pressure tubing connector 70 is connected to the bottom of the high pressure valve 72 by means of a threaded union or flange at point 76. The bottom of the high pressure tubing connector 70 is provided with a short cylindrical threaded bore which has a larger diameter than the vertical passage 32 to accept a threaded sleeve 78, shown in FIG. 1*a*. The threaded sleeve 78 interconnects the high pressure tubing 64 and high pressure tubing connector 70. The high pressure tubing 64 is screwed into the bottom of the threaded sleeve 78 and sealed thereto by means of O-ring 80 to form a rigid connection. Threaded sleeve 78 is provided in a variety of internal diameters to accommodate different sizes of high pressure tubing 64. The bottom of the high pressure tubing connector 70 is also designed to connect with the stuffing box housing 58 extending from base plate member 48, by means of a hold down connector 82 comprising a threaded union or flange, which screws onto the stuffing box housing 58. Hold down connector 82 must be robust enough to withstand the upward hydraulic thrust exerted on packoff nipple assembly 68 and translated upwardly through high pressure tubing 64 to the high pressure tubing connector 70. It is illustrated in FIG. 1*a* as a threaded union but may be flanges or similar connectors.

The packoff nipple assembly 68, as illustrated in FIG. 1 is attached to the bottom of high pressure tubing 64 by means of a threaded connector or may be made integral with the high pressure tubing 64. The packoff nipple assembly 68 is the means by which pressure is isolated from the well tree and has a steel member having a bore therethrough of the same diameter as the bore of a high pressure tubing 64. Attached to the circumference of the steel member of packoff nipple assembly 68 is either a permanent or a replaceable compressible rubber cup and/or a rubber sleeve. The compressible rubber cup and/or sleeve have a slightly larger outside diameter than the inside diameter of the production tubing 24. The packoff nipple assembly 68 may comprise more than one compressible rubber cup and/or sleeve and is designed with a taper to facilitate its insertion into the production tubing 24.

A Chicksan swivel 84 is connected to a top of the high pressure valve 72 by means of threaded connection (not shown). The Chicksan swivel 84 is a U-shaped tubing connector having swivels incorporated therein which permit the U-shaped connector to be rotated in the horizontal plane and positioned in any direction for connection of a high pressure hose for the high pressure fluids, gases, solid particles or mixtures to be injected when the other end thereof is sealingly connected to the top of the high pressure valve 72.

The base plate member 48 preferably has a vertical bore 86 which has a diameter larger than an exterior diameter of the swedge 46 and is located in a position offset from the cylindrical bore 49 to permit the swedge 46 to pass therethrough. Four eyes 88 are provided on the upper surface of the base plate member 48. The eyes 88 are circumferentially spaced apart and symmetrically located near a periphery of the base plate member 48. The eyes 88 are used to connect a high pressure tube insertion assembly which will be described below with reference to FIG. 2.

The swedge 46 is an 8-foot long pipe with two opposed threaded ends for sealed connection of a top of the second stack 22 of the dual string well tree 12 and the bottom of the second assembly 44, respectively. An axial passage 90 of the swedge 46, defined by the interior of the pipe has a diameter equal to or larger than the second vertical passage 34 to accommodate a high pressure tubing 92 of the second assembly 44. The swedge 46 supports the second isolation assembly 44 and vertically offsets the second isolation assembly from the first to avoid interference between the two isolation assemblies. Therefore, the swedge 46 must be able to support the second isolation assembly 44 in combination with a hydraulic cylinder assembly 94 that is shown in FIG. 2.

In this example, the two production tubing strings 24 and 26 are assumed to have the same diameter and, therefore, the two vertical passages 32, 34 of the dual string well tree 12 have the same diameter. The second assembly 44 has the same structure and components as those of the first assembly 42, except that the high pressure tubing 92 is longer than the high pressure tubing 64 and an extra hammer union 96 is provided for sealed connection of the flow cross or tee 54 of the second isolation assembly 44 and the top end of the swedge 46. The same reference numerals are used to identify parts of the second isolation assembly 44 that are identical to those of the first assembly 42. If the two production tubing strings have different diameters, parts of the second isolation assembly 44 are not identical to the first assembly 42. Nevertheless, the structure of the second assembly 44 will be the same as that of the first assembly 42.

FIG. 2 illustrates a process in which a hydraulic assembly 94 is used to insert the high pressure tubing 64 of the first isolation assembly 42 into the vertical passage 32 of the dual string well tree 12. A cap 36 sealingly secured to the top of the first stack 22 is removed after the valve 38 is closed. The flow cross or tee 54 with the test valve 56 is connected to the bottom of the base plate member 48 by connecting the flanges 50 and 52 together. Before the combination of the base plate member 48 and the flow cross or tee 54 with the test valve 56 is mounted to the top of the first stack 20 of the dual string well tree 12, the high pressure tubing 64 is inserted from the top of the stuffing box housing 58 into the cylindrical bore 49 of the base plate member 48 until a lower end or the high pressure tubing 64 projects out from the bottom of the flow cross or tee 54 to accept the packoff nipple assembly which is attached thereto. However, if a packoff nipple assembly is incorporated into the lower end of the high pressure tubing 64, the high pressure tubing 64 is inserted upwardly from the bottom of the flow cross or tee 54 into the cylindrical bore 49 of the base plate member 48 shown in FIG. 2*a*. After the high pressure tubing 64 is inserted into the combination of the base plate member 48 and the flow cross or tee 54, the combination is mounted to a top of the first stack 20 of the dual string well tree 12 using a threaded connection between the bottom of the flow cross or tee 54 and the top of the first stack 20.

The top end of the high pressure tubing 64 is then connected to the high pressure valve 72 using the high pressure tubing connector 70. As shown in FIG. 2*b*, the threaded sleeve 78 interconnects the high pressure tubing 64 and the high pressure tubing connector 70. However, the hold down connector 82 is disconnected from the stuffing box housing 58 of the base plate member 48. Therefore, the combination of the high pressure tubing 64, the high pressure tubing connector 70 and the high pressure valve 72 is free for vertical displacement relative to the base plate member 64. The combination moves downwardly under its own weight until the packoff nipple assembly 68 at the lower end of the high pressure tubing 64 is stopped by the closed valve 38. The high pressure valve 72 is opened to permit air trapped inside of the cylindrical bore 49 and the high pressure tubing 46 to escape during the downward movement and the high pressure valve 72 is closed after the downward movement is complete. The hydraulic cylinder assembly 94 used to complete the insertion of the high pressure tubing into the vertical passage of the dual string well tree preferably includes four vertical support rods 98 that are respectively mounted to the eyes 88 of the base plate member 48. As illustrated in FIG. 2*c*, each of the support rods 98 has a slot 100 extending transversely at its lower end to accommodate one of the eyes 88. A transverse bore, not shown, extends through the support rod 98 and across the groove 100 at a right angle thereto. A bolt 102 extends through the transverse bore and the eyes 88 to pivotally connect the support rod 98 to the base plate member 48. The bolt 102 is locked by a pin 104. Alternatively, the ends of the support rods 98 may be threaded and adapted to project through holes drilled in the base plate member 48 and secured by nuts or similar fasteners. Supports rods 98 are oriented to extend upwardly parallel to vertical passage 32. The support rods 92 are also connected to a hydraulic cylinder support plate 104 in a similar manner. Hydraulic cylinder support plates 104 have generally the same shape and size as base plate member 48 and the eyes for the support rods 48 are identically placed on base plate member 48. The hydraulic cylinder 106 may be attached to hydraulic cylinder support plate 104 by means of welding or threaded engagement. Hydraulic cylinder 106 is mounted in a bore in the center of hydraulic cylinder support plate 104 and is oriented in an axial alignment with the first vertical passage 32 of the dual string well tree 12. It will be understood by a person skilled in the art that at least two support rods are necessary to support the hydraulic cylinder and any symmetric arrangement of more than two support rods may be functional.

A piston 108 is mounted for reciprocal movement in cylinder 106. The hydraulic cylinder 106 is provided with two hydraulic fluid ports 110 and 112. Extending from the bottom of the piston 108 is a piston rod 114. Piston rod 114 is aligned vertically over the first vertical passage 32 and reciprocates with the hydraulic movement of the piston 108 under pressure from hydraulic fluid introduced through ports 112 or 114. Piston rod 114 passes through the bottom of a hydraulic cylinder 106 by way of a sealing mechanism and through the central bore in hydraulic cylinder support plate 104.

Attached to the bottom of piston rod 114 is a connector 116. Connector 116 is a threaded union or a flange adapted to attach to the top of the high pressure valve 72 when the length of the support rods 98 are appropriately selected and the piston rod 114 is retracted into the cylinder 116. The high pressure tubing 64 and the high pressure valve 72 are now ready to be inserted by the hydraulic cylinder assembly 94 to an operative position in the first production tubing 24.

After the test valve 56 is closed and the valve 38 is opened, hydraulic fluids are introduced through the port 110 into the hydraulic cylinder 106 and the piston 108 and the piston rod 114 move down so that the combination of the high pressure tubing 64, high pressure tubing connector 70 and the high pressure valve 72 are forced to move downwardly and the high pressure tubing 64 is further inserted into the vertical passage 32 against the natural pressure in the first production tubing string 24 induced by oil, gas or water originated from the formation.

The downward movement of the combination of high pressure tubing 64, high pressure tubing connector 70 and the high pressure valve 72 continues until the union 82 meets the stuffing box housing 58, at which point packoff nipple assembly 68 is seated inside the first production tubing 24, as shown in FIG. 1. Union 82 is then secured to stuffing box housing 58 and the test valve 56 is opened to bleed off pressure in the interior of a vertical passage 32. A seal between packoff nipple assembly 68 and the first production tubing string 24 is confirmed upon stoppage of the flow from test valve 56. If a long well tree is being isolated by the apparatus of the invention, a single stroke of the hydraulic piston rod 114 may not be adequate to seat the packoff nipple assembly 68 in the first production tubing string 24. When this is the case, the high pressure valve 72 is temporarily connected to an adjustable hold-down (not illustrated) to secure it in position while the piston rod 114 is disconnected and the hydraulic piston 108 is reversed to the top of the hydraulic cylinder 106. A hydraulic piston rod extension (not illustrated) is then connected between the bottom of the piston rod 114 and the top of the high pressure valve 72 and the hydraulic cylinder is again activated to continue the insertion of the high pressure tubing 64. This procedure is described in the Applicant's U.S. Pat. No. 4,867,243, which is incorporated herein by reference.

Figure 3:
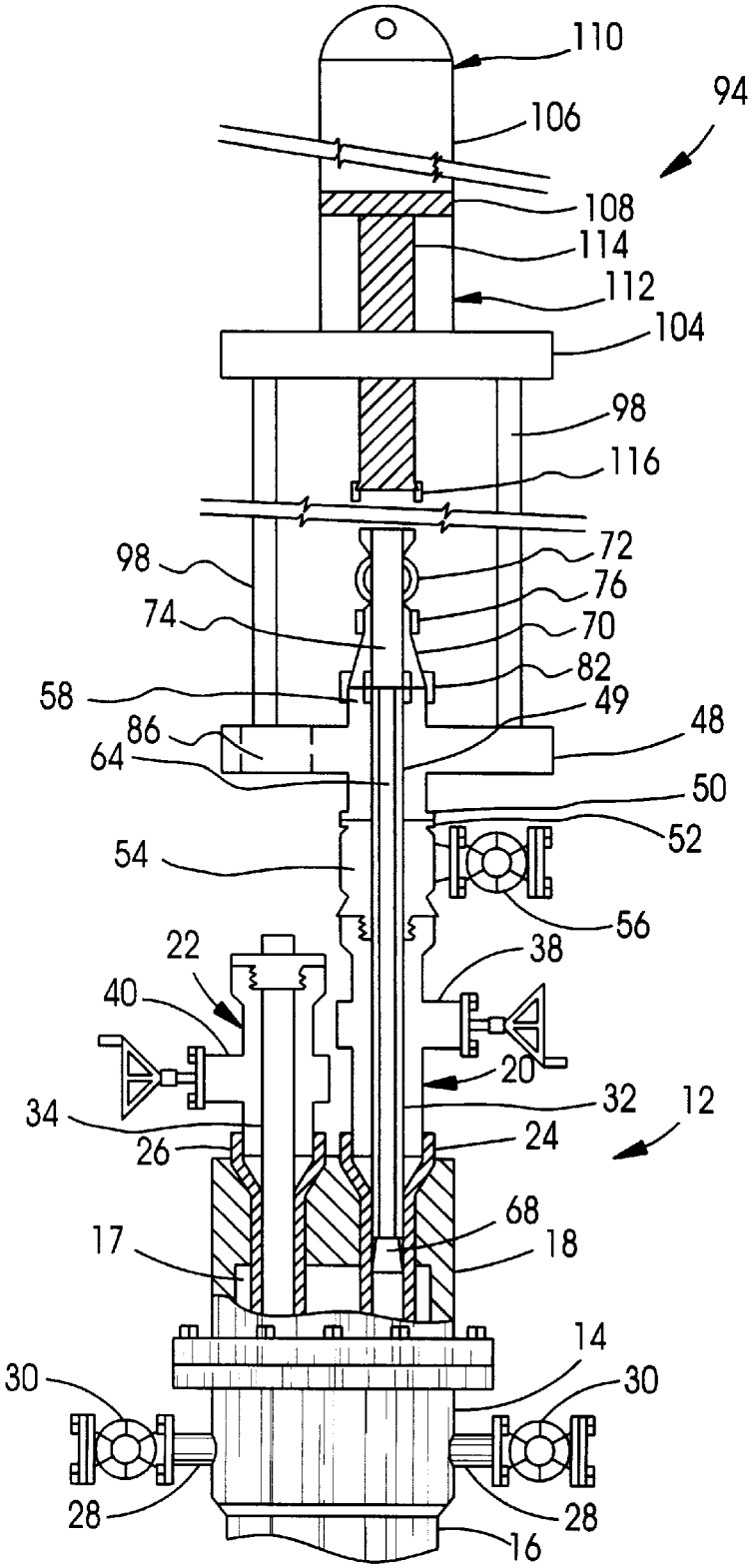
FIG. 3 shows a partially cut away side view of the dual string well tree shown in FIG. 1 with the first assembly of the isolation apparatus attached, the high pressure tubing inserted to an operative position in the production tubing string and the piston rod hydraulic cylinder disengaged from the assembly.

FIG. 3 illustrates the first assembly of the isolation apparatus after the high pressure tubing 64 has been inserted through the vertical passage 32 of the dual string well tree 12 and the packoff nipple assembly 68 is seated in the production tubing 24, thereby isolating pressure inside of the production tubing 24 and the high pressure tubing 64 from the vertical passage 32 of the dual string well tree. Test valve 56 is in the open position to bleed off pressure in the vertical passage 32 and to ensure that a seal has been obtained. High pressure valve 72 is closed to prevent the escape of hydrocarbons from the production tubing 32 through the high pressure tubing 64. Union 82 is attached to stuffing box housing 58, as indicated in FIG. 1*a*. Union 82 and stuffing box housing 58 hold down high pressure tubing 64 so that the connector 116 may be disconnected from the top of the high pressure valve 72 and the entire hydraulic cylinder assembly 94 including the cylinder 106, support plate 104 and support rods 98 may be removed from the dual string well tree 12. The Chicksan swivel 84 is then connected to the top of the first stack 20 of the dual string well tree, as shown in FIG. 1. Union 82 and stuffing box housing 58 must be sufficiently robust to resist the upward thrust exerted on the high pressure tubing 64 and the high pressure valves 72 during a well stimulation treatment.

Before the second assembly 44 is mounted to the second stack 22 of the dual string well tree 12, the swedge 46 must be mounted to the top of the second stack 22. Because the base plate member 48 of the first assembly 42 is mounted to the first stack 20 of the dual string well tree 12 in such a manner that the vertical bore 86 is aligned with the second vertical passage 34 in the second stack 22, the swedge 46 is adapted to extend down through a vertical bore 86 of the base plate member 48 and is connected to the top of the second stack 22, as shown in FIG. 1.

The procedure of the attachment of the second isolation assembly 44 to the top of the swedge 46 and the insertion of the second high pressure tubing 34 to the operative position in the second production tubing string 26 are similar to the procedure for the first isolation assembly described in detail above. It should only be noted that the high pressure tubing 92 has a longer length than that of the high pressure tubing 64 of the first assembly 42 because the high pressure tubing 92 must be inserted through the entire length of the swedge 46 and the second stack 22. However, a hydraulic cylinder having a longer stroke is not required for the insertion of the high pressure tubing 64. The swedge 46 has an uninhibited vertical passage therethrough and the high pressure tubing 92 is able to move down under its own weight as described above until the packoff nipple assembly 68 at the lower end of the high pressure tubing 92 is stopped by the valve 40, which is closed to prevent the escape of pressure and hydrocarbons from the second stack 22. Therefore, the length of the high pressure tubing 92 inserted by the hydraulic cylinder assembly 94 is not significantly different from the length of the high pressure tubing 32 inserted in the first stack 20. After the two high pressure tubings are respectively inserted to their operative positions in the two production tubing strings, the dual string well tree 12 is ready for a stimulation treatment.

FIGS. 4*a*–4*d* illustrate acceptable examples for the structure of the base plate member 48. The acceptable structures for the base plate member 48 shown in FIGS. 4*a*–4*d* are clearly self-explanatory and are readily understandable by those skilled in the art. Other optional structures for the base plate member may be used if they enable stable attachment of the support rods and accommodate passage of the swedge 46.

Once the well stimulation treatment is completed, the hydraulic cylinder assembly 94 is hoisted back onto the dual string well tree and attached thereto. The high pressure tubings 64 and 92 and the swedge 46 are removed from the dual string well tree by reversing the procedure described above for the insertion of the high pressure tubings 64 and 92.

Changes and modifications of the preferred embodiments of the invention described above may become apparent to persons skilled in the art. The scope of the invention is therefore intended to be limited solely by the scope of the appended claims.

I claim:

1. An apparatus for injecting fluids, gases, solid particles or mixtures thereof into a well having first and second production tubing strings, the fluids being injected through a dual string well tree which has first and second vertical passages therethrough respectively aligned with the first and second production tubing string and has at least one valve for selectively closing each passage, the apparatus comprising:

a first and a second isolation assembly, each having a high pressure tubing for insertion through the respective first and second vertical passages to isolate the fluids, gases, solid particles or mixtures injected therethrough from an interior of each of the vertical passages;

a swedge having an axial passage adapted to be detachably mounted to the dual string well tree in sealed alignment with one of the vertical passages, the swedge having a top end adapted to support one of the assemblies to vertically offset the one assembly from the other.

2. An apparatus as claimed in claim 1 further comprising an actuating mechanism adapted to insert the high pressure tubing of each of the assemblies into the respective vertical passages.

3. An apparatus as claimed in claim 2 wherein the actuating mechanism comprises a hydraulic cylinder and supportive device fixable relative to the dual string well tree to support the hydraulic cylinder in an operative position each time the hydraulic cylinder is actuated to insert a high pressure tubing into a respective vertical passage.

4. An apparatus as claimed in claim 3 wherein each of the assemblies comprises a hold down mechanism for detachably securing the assembly to the dual string well tree when the high pressure tubing of the assembly is inserted in an operative position into the vertical passage.

5. An apparatus as claimed in claim 4 wherein each of the assemblies comprises sealing devices adapted to prevent passage of both the fluids and gases from an exterior of the high pressure tubing and an interior of the vertical passage to atmosphere, and from an interior of the high pressure tubing and an interior of the production tubing string to the vertical passage when the high pressure tubing is inserted into the vertical passage in the operative position.

6. An apparatus for injecting fluids, gases, solid particles or mixtures thereof into a well having first and second production tubing strings, the fluids being injected through a dual string well tree which has first and second vertical passages therethrough respectively aligned with the first and second production tubing strings and has at least one valve for selectively closing each passage, the apparatus comprising:

first and second isolation assemblies for injecting the fluids through the respective first and second vertical passages, each of the isolation assemblies including:

(a) a high pressure tubing for insertion through a respective one of the vertical passages;

(b) a high pressure valve connected to the high pressure tubing to selectively stop fluid flow through the high pressure tubing;

(c) a first sealing device adapted to prevent passage of the fluids and gases from an exterior of the high pressure tubing and an interior of the vertical passage to atmosphere;

(d) a second sealing device adapted to prevent passage of the fluids and gases from an interior of the high pressure tubing and an interior of the production tubing to the vertical passage when the high pressure tubing is inserted into the vertical passage;

(e) a hold down mechanism for detachably securing the high pressure tubing and the high pressure valve to the dual string well tree;

a swedge having an axial passage, adapted to be detachably mounted to the dual string well tree in alignment with the second vertical passage to extend the second vertical passage upwardly past the first high pressure valve when the high pressure valve is secured by the hold down mechanism, the second high pressure tubing being inserted into the second vertical passage from a top end of the swedge;

a hydraulic cylinder having an extendable and retractable piston rod that is respectively and detachably connected to each of the first and second assemblies for inserting the first high pressure tubing into the first vertical passage and the second high pressure tubing into the second vertical passage; and at least two elongated hydraulic cylinder support rods fixable relative to the dual string well tree in a respective position parallel with and offset from the vertical passages respectively and adapted to support the hydraulic cylinder in axial alignment with the respective vertical passage, the support rods and the hydraulic cylinder being removable from the dual string well tree when each of the high pressure tubings is operatively inserted into a respective vertical passage.

7. An apparatus as claimed in claim 6 wherein each assembly comprises a base plate member having a central bore adapted for attachment to the dual string well tree, the central bore being aligned with a respective vertical passage to permit the insertion of the high pressure tubing, and at least two points of attachment for the support rods, the points of the attachment being offset from the vertical passage.

8. An apparatus as claimed in claim 7 wherein the base plate member of the first assembly includes a passage to accommodate the swedge.

9. An apparatus as claimed in claim 7 wherein the hydraulic cylinder is mounted to a cylinder plate member, the cylinder plate member having a central bore to permit the passage of the piston rod therethrough and at least two points of attachment for the support rods, the points of the attachment being symmetrical about the central bore and complementary with the points of attachment on the base plate member.

10. An apparatus as claimed in claim 6 wherein each of the isolation assemblies comprises a U-shaped hose connector sealingly and swivelably connected to the high pressure valve and adapted to permit connection of a high pressure hose for the high pressure fluids, gases, solid particles or mixtures to be injected when the high pressure tubing is inserted into the vertical passage and the hydraulic cylinder and support rods are removed.

11. An apparatus as claimed in claim 7 wherein the first sealing device is incorporated in the base plate member; and the second sealing device is affixed to a bottom end of the high pressure tubing.

12. An apparatus as claimed in claim 7 wherein the hold down mechanism comprises a high pressure valve connector having opposed ends and an axial bore therethrough, and adapted on its one end for attachment to the high pressure valve and on its other end for attachment to the base plate member.

13. An apparatus as claimed in claim 12 wherein the high pressure valve connector is further provided with an attachment mechanism for the high pressure tubing, the attachment mechanism comprising:

a threaded bore coaxial with the bore in the high pressure valve;

a threaded sleeve having an external diameter complementary with the threaded bore and an internal diameter complementary with a threaded end of the high pressure tubing so that the high pressure valve connector is adapted for attachment of high pressure tubings with different diameters when the threaded sleeve is changed; and a sealing mechanism to prevent passage of the fluids and gases from an interior of the bore and the exterior of the high pressure tubing to atmosphere.

14. An apparatus as claimed in claim 7 wherein the base plate member further comprises a test port having a passage to the central bore of the base plate member, and a test valve for closing the test port, the test port and test valve being adapted to test leakage of the sealing device and sealing mechanism when the high pressure tubing is inserted into the vertical passage and the test valve is opened.

15. A method of isolating a dual string well tree having first and second vertical passages, aligned respectively with first and second production tubing strings of an oil or gas well, from the effects of high pressure or corrosion caused by stimulation of the well, the method comprising steps of:

(a) mounting a first isolation assembly having a high pressure tubing to the dual string well tree in alignment with the first vertical passage, and inserting the high pressure tubing through the vertical passage to an operative position in the first production tubing string to isolate fluids, gases, solid particles and mixtures injected therethrough from an interior of the first vertical passage;

(b) securing the high pressure tubing of the first isolation assembly to the dual string well tree;

(c) mounting a swedge having an axial passage to the dual string well tree, the axial passage being sealingly aligned with the second vertical passage and a top end of the swedge being vertically offset from a top of the first assembly;

(d) mounting a second isolation assembly having a high pressure tubing to the swedge in alignment with the second vertical passage, and inserting the high pressure tubing through the swedge and the second vertical passage to an operative position in the second production tubing string to isolate fluids, gases, solid particles and mixtures injected therethrough from an interior of the second vertical passage; and (e) securing the high pressure tubing of the second assembly to the dual string well tree.

16. A method as claimed in claim 15 wherein each of the respective insertions of the high pressure tubing into the vertical passages of the dual string well tree is accomplished using a hydraulic cylinder secured in an operative position so that the hydraulic cylinder is aligned with the high pressure tubing to be inserted, the hydraulic cylinder being supported by a cylinder support fixable relative to the dual string well tree.

17. A method as claimed in claim 16 further comprising steps of:

securing the cylinder support to the dual string well tree to locate the hydraulic cylinder in the operative position before each of the insertions of the high pressure tubing into the respective vertical passages; and disengaging the cylinder support from the dual string well tree each time one of the respective high pressure tubings is inserted into the vertical passages to the operative position.

* * * * *